US009773464B2

(12) United States Patent
Azumi et al.

(10) Patent No.: US 9,773,464 B2
(45) Date of Patent: Sep. 26, 2017

(54) TOUCH DETECTION DEVICE AND DISPLAY DEVICE HAVING TOUCH DETECTION FUNCTION WHICH COMPRISE TOUCH DRIVER UPDATING DRIVE SYNCHRONIZING SIGNAL FOR PRODUCING TOUCH DRIVE SIGNAL BASED ON SIGNAL INPUT FROM DISPLAY DRIVER

(71) Applicant: Japan Display Inc., Tokyo (JP)

(72) Inventors: Kohei Azumi, Tokyo (JP); Hirofumi Nakagawa, Tokyo (JP); Hiroshi Mizuhashi, Tokyo (JP); Makoto Hayashi, Tokyo (JP)

(73) Assignee: Japan Display Inc., Tokyo (JP)

( * ) Notice: Subject to any disclaimer, the term of this patent is extended or adjusted under 35 U.S.C. 154(b) by 156 days.

(21) Appl. No.: 14/734,782

(22) Filed: Jun. 9, 2015

(65) Prior Publication Data

US 2015/0364117 A1 Dec. 17, 2015

(30) Foreign Application Priority Data

Jun. 13, 2014 (JP) ..... 2014-122107

(51) Int. Cl.
*G09G 5/18* (2006.01)
*G09G 3/36* (2006.01)

(52) U.S. Cl.
CPC ..... *G09G 3/3611* (2013.01); *G09G 3/3655* (2013.01); *G09G 3/3674* (2013.01); *G09G 3/3685* (2013.01); *G09G 2300/023* (2013.01); *G09G 2300/0426* (2013.01)

(58) Field of Classification Search
CPC ..... G09G 2300/023; G09G 2300/0426; G09G 3/3611; G09G 3/3655; G09G 3/3674; G09G 3/3685
See application file for complete search history.

(56) References Cited

U.S. PATENT DOCUMENTS

2007/0262966 A1* 11/2007 Nishimura ..... G06F 3/044 345/173
2011/0187677 A1* 8/2011 Hotelling ..... G06F 3/0412 345/174
2011/0210939 A1* 9/2011 Reynolds ..... G06F 3/0418 345/174
2012/0050217 A1 3/2012 Noguchi et al.
(Continued)

FOREIGN PATENT DOCUMENTS

JP 2012-48295 A 3/2012

*Primary Examiner* — Lun-Yi Lao
*Assistant Examiner* — Johny Lau
(74) *Attorney, Agent, or Firm* — Michael Best & Friedrich LLP

(57) ABSTRACT

According to one embodiment, a touch detection device includes a plurality of drive electrodes, a plurality of detection electrodes, a display driver which performs a touch scanning drive by supplying a touch drive signal to a target drive electrode to be driven, and a touch driver which transmits and receives a signal to and from the display driver, wherein at least one of the number of pulses of the drive synchronizing signal and a pulse width of each of the pulses of the drive synchronizing signal is determined based on the signal received from the display driver.

13 Claims, 10 Drawing Sheets

(56) References Cited

U.S. PATENT DOCUMENTS

| | | | | |
|---|---|---|---|---|
| 2012/0056835 | A1* | 3/2012 | Choo | G06F 3/0412 345/173 |
| 2012/0113045 | A1* | 5/2012 | Lai | G06F 3/0416 345/174 |
| 2012/0262390 | A1* | 10/2012 | Kida | G06F 3/041 345/173 |
| 2013/0057512 | A1* | 3/2013 | Lillie | G06F 3/044 345/174 |
| 2013/0176213 | A1* | 7/2013 | Toorians | G06F 3/0416 345/157 |
| 2013/0176251 | A1* | 7/2013 | Wyatt | G09G 5/18 345/173 |
| 2013/0194229 | A1* | 8/2013 | Sabo | G06F 3/044 345/174 |
| 2013/0241868 | A1* | 9/2013 | Kim | G09G 3/3685 345/174 |
| 2014/0022185 | A1* | 1/2014 | Ribeiro | G06F 3/0412 345/173 |

* cited by examiner

TOUCH DETECTION DEVICE AND DISPLAY DEVICE HAVING TOUCH DETECTION FUNCTION WHICH COMPRISE TOUCH DRIVER UPDATING DRIVE SYNCHRONIZING SIGNAL FOR PRODUCING TOUCH DRIVE SIGNAL BASED ON SIGNAL INPUT FROM DISPLAY DRIVER

CROSS-REFERENCE TO RELATED APPLICATIONS

This application is based upon and claims the benefit of priority from Japanese Patent Application No. 2014-122107, filed Jun. 13, 2014, the entire contents of which are incorporated herein by reference.

FIELD

Embodiments described herein relate generally to a touch detection device and a display device having a touch detection function.

BACKGROUND

In recent years, attention has been given to display devices in which a touch detection device referred to as a so-called touch panel is provided on a display device such as a liquid crystal display device, or a touch panel and a display device are integrated as a single body, and the display device is made to display various button images to enable information to be input without ordinary real buttons. Such display devices having a touch detection function do not need input devices such as a keyboard, a mouse and a keypad, and thus tend to be broadly used as display devices of computers, portable information terminals such as cell phones, etc.

As such a touch panel, a capacitive touch panel is known in which a plurality of electrodes each formed to extend in a single direction are intersected to each other. In this touch panel, the electrodes are connected to a control circuit, and when supplied with an excitation current from the control circuit, they detect proximity of an external object.

As a display device having a touch detection function, a so-called in-cell touch panel is proposed in addition to a so-called on-cell touch panel in which a touch panel is provided on a display surface of a display device. In the in-cell display device, a common electrode for display, which is originally provided in the display device, is also used as one of a pair of electrodes for a touch sensor, and the other of the pair of electrodes (a touch detection electrode) is provided to intersect the common electrode.

A display device having a touch detection function is disclosed (in Jpn. Pat. Appln. KOKAI Publication No. 2012-48295) in which drive electrodes for touch sensor are sequentially selected in a time sharing manner such that a predetermined number of drive electrodes for touch sensor are selected at a time; a touch detection drive signal is supplied to selected drive electrodes; and a scanning drive is performed at a scanning pitch which is smaller than the total width of the selected drive electrodes.

It should be noted that in a drive method disclosed in the above patent publication, it is necessary to synchronize a display operation and a touch drive operation with each other in order that they be performed in a time sharing manner in a single frame period. Thus, in the above touch detection device, a touch driver (TPIC) which controls the touch drive operation and a display driver (DDI) which controls the display operation execute a touch drive control in cooperation with each other.

Also, it should be noted that the touch driver TPIC and the display driver DDI are configured to operate in synchronism with clocks generated by standard frequency generators provided in the touch driver (TPIC) and the display driver (DDI), respectively. That is, clocks for the operations of the touch driver (TPIC) and the display driver (DDI) are different from each other in master clock. Therefore, it is necessary that the touch driver (TPIC) and the display driver (DDI) are designed in consideration of the case where the difference between the clocks for the touch driver (TPIC) and the display driver (DDI) is the maximum (the worst case).

BRIEF DESCRIPTION OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

Figure 1:
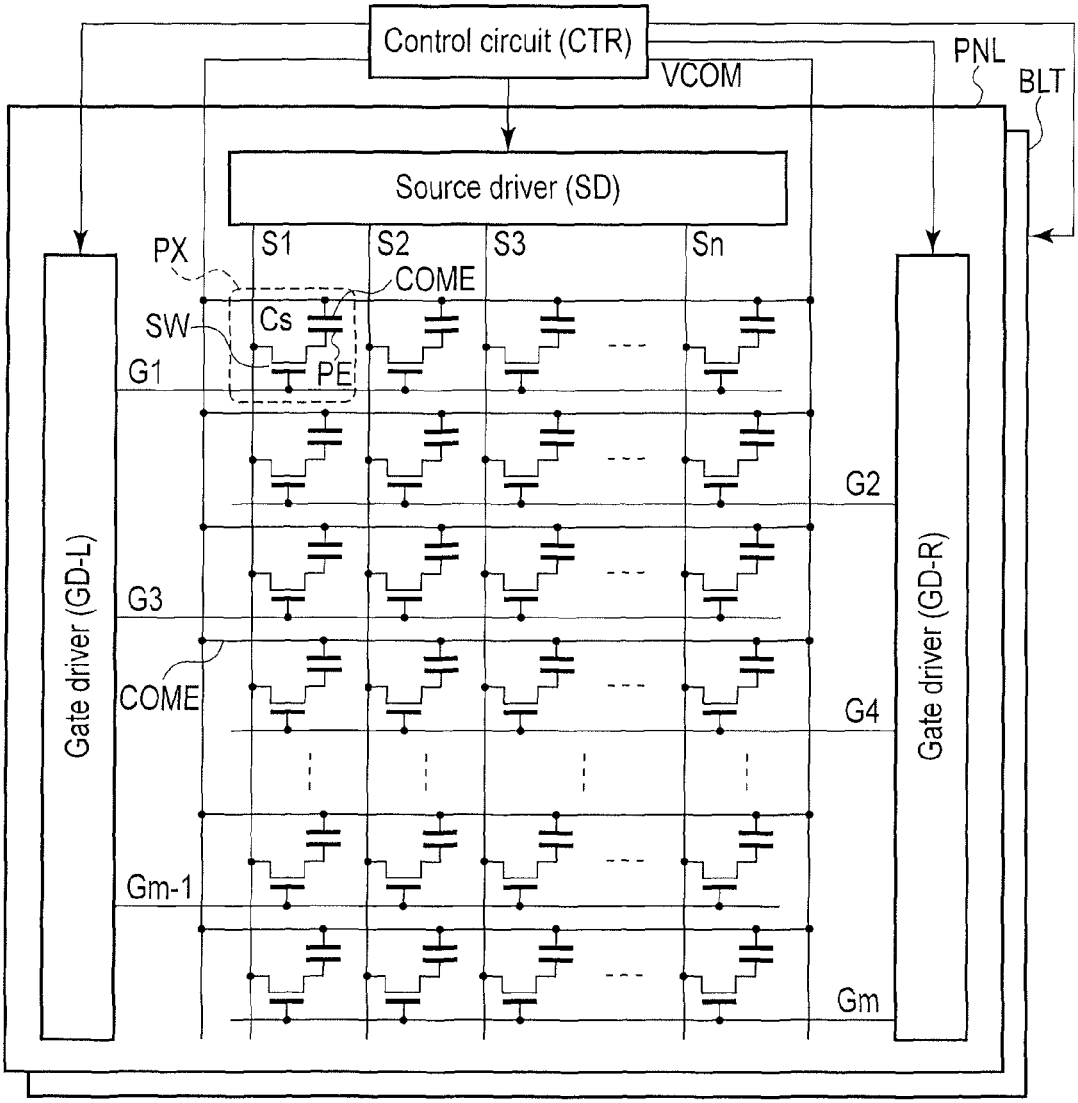
FIG. 1 is an exemplary view schematically showing a structure of a display device of a display device having a touch detection function, according to a first embodiment.

Various embodiments will be described hereinafter with reference to the accompanying drawings.

In general, according to one embodiment, a touch detection device includes: a plurality of drive electrodes arranged side by side to extend in a single direction; a plurality of detection electrodes extending in a direction crossing the direction in which the drive electrodes extend, and provided to generate capacitances at intersections of the detection electrodes and the drive electrodes; a display driver configured to perform a touch scanning drive by supplying a touch drive signal having pulses for detecting a closely situated external object to a target drive electrode to be driven, which is selected from the drive electrodes; and a touch driver configured to transmit and receive a signal to and from the display driver, output a drive synchronizing signal for producing the touch drive signal to the display driver, and acquire detection signals from the detection electrodes at timing corresponding to inputting of the touch drive signal, to thereby detect the closely situated external object, wherein at least one of the number of pulses of the drive synchronizing signal and a pulse width of each of the pulses of the drive synchronizing signal is determined based on the signal received from the display driver.

Various embodiments will be described hereinafter with reference to the accompanying drawings.

It should be noted that they are described as examples, and needless to say, if they are modified as appropriate without departing from the subject matter of the invention, and easily conceived by a person with ordinary skill in the art, such a modification or modifications fall within the scope of the present invention. Furthermore, some part of the drawings schematically show elements in width, thickness, shape, etc., as compared with actual ones. They show them by way of example, and do not limit an interpretation of the present invention. In addition, in the specification and the drawings, elements identical to those explained previously will be denoted by the same reference numerals as the previously explained elements, and after they are each explained once, detailed explanations of some of the elements will be omitted as appropriate.

First Embodiment

FIG. 1 is an exemplary view schematically showing a structure of a display device of a display device DSP having a touch detection function, according to the first embodiment. It should be noted that in the first embodiment, the display device is a liquid crystal display device; and "touch detection" is a term which means not only that it is detected that a finger or the like contacts a touch panel, but that it is detected that the finger or the like is located close to the touch panel.

The display device comprises a display panel PNL and a backlight BLT which illuminates the display panel PNL from a rear surface side thereof. The display panel PNL comprises a display portion including display pixels PX arranged in a matrix.

As shown in FIG. 1, the display portion comprises gate lines G (G1, G2, . . . ), source lines S (S1, S2, . . . ) and pixel switches SW, the gate lines G extending along display pixels PX arranged in a row direction, the source lines S extending along display pixels PX arranged in a column direction, the pixel switches SW arranged close to intersections of the gate lines G and the source lines S.

The pixel switches SW comprise thin film transistors (TFTs). Gate electrodes of the pixel switches SW are electrically connected to associated gate lines G. Source electrodes of the pixel switches SW are electrically connected to associated source lines S. Drain electrodes of the pixel switches SW are electrically connected to associated pixel electrodes PE.

Furthermore, as drive means for driving the display pixels PX, gate drivers GD (left GD-L and right GD-R) and a source driver SD are provided. The gate lines G are electrically connected to output terminals of the gate drivers GD. The source lines S are electrically connected to output terminals of the source driver SD.

The gate drivers GD and the source driver SD are located in a peripheral area (frame edge) of the display area. The gate drivers GD successively applies on-voltages to the gate lines G, as a result of which the on-voltages are applied to the gate electrodes of pixel switches SW, which are electrically connected to selected gate lines G. To be more specific, when an on-voltage is applied to a gate electrode, electrical conduction is effected between a source electrode and a drain electrode of a pixel switch SW including the above gate electrode. On the other hand, the source driver SD supplies output signals to the source lines S, respectively. To be more specific, when an output signal is supplied to a source line S, it is also supplied to an associated pixel electrode PE through the pixel switch SW in which electrical conduction is effected between its source and drain electrodes.

Operations of the gate drivers GD and the source driver SD are controlled by a control circuit CTR provided outside the liquid crystal display panel PNL. Furthermore, the control circuit CTR applies a common voltage Vcom to a common electrode COME which will be described later, and also controls an operation of the backlight BLT.

Figure 2:
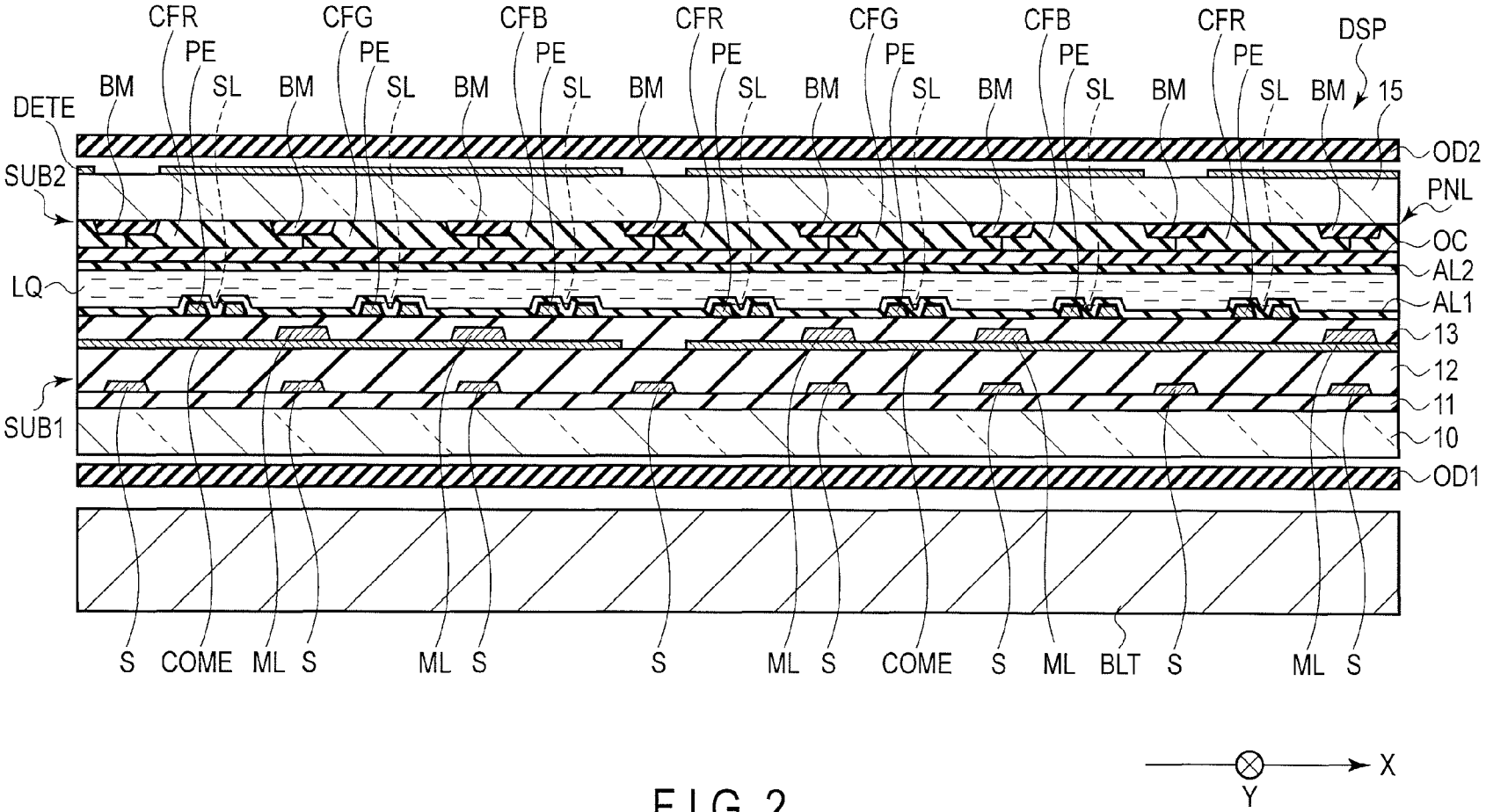
FIG. 2 is an exemplary cross-sectional view showing in more detail the structure of the display device having the touch detection function according to the first embodiment.

FIG. 2 is an exemplary cross-sectional view showing in more detail the structure of the display device DSP having the touch detection function, according to the first embodiment.

The display device DSP having the touch detection function comprises a display panel PNL, a backlight BLT, a first optical element OD1 and a second optical element OD2. In an example shown in FIG. 2, the display panel PNL is a liquid crystal display panel; however, as the display panel PNL, another type flat panel such as an organic electroluminescence display panel may be applied. Also, the display panel PNL as shown in FIG. 2 has a structure conforming to a fringe field switching (FFS) mode which is a display mode; however, it may have a structure conforming to another display mode.

The display panel PNL comprises a first substrate SUB1, a second substrate SUB2 and a liquid crystal layer LQ. The first substrate SUB1 and the second substrate SUB2 are stacked together, with a predetermined cell gap interposed between them. The liquid crystal layer LQ is held in the cell gap between the first substrate SUB1 and the second substrate SUB2.

The first substrate SUB1 is formed using a first insulating substrate 10 having a light transmission characteristic, such as a glass substrate or a resin substrate. On a side of the first insulating substrate 10 which is located opposite to the second substrate SUB2, the first substrate SUB1 comprises source lines S, a common electrode COME, pixel electrodes PE, a first insulating film 11, a second insulating film 12, a third insulating film 13, a first alignment film AL1, etc.

The pixel electrodes PE and the common electrode COME form, along with a pixel area of the liquid crystal layer which is located between those electrodes, display pixels; and the display pixels are arranged in a matrix in the display panel PNL.

The first insulating film 11 is provided on the first insulating substrate 10. It should be noted that although it will not be explained in detail, between the first insulating substrate 10 and the first insulating film 11, the gate lines G, gate electrodes of switching elements, a semiconductor layer, etc., are provided. The source lines S are formed on the first insulating film 11. Also, drain electrodes and source electrodes of the switching elements, etc., are formed on the first insulating film 11. In the example shown in the figure, the source lines S extend parallel to the common electrode COME in a second direction Y.

The second insulating film 12 is provided on the source lines S and the first insulating film 11. The common electrode COME is formed on the second insulating film 12. In the example shown in the figure, the common electrode COME comprises a plurality of segments. The segments of the common electrode COME extend in the second direction Y, and spaced from each other in a first direction X. Such a common electrode COME is formed of a transparent conductive material such as indium tin oxide (ITO) or indium zinc oxide (IZO). It should be noted that in the example shown in the figure, although metal layers ML are formed on the common electrode COME to reduce the resistance of the common electrode COME, they may be omitted.

The third insulating film 13 is provided on the common electrode COME and the second insulating film 12. The pixel electrodes PE are formed above the third insulating film 13. Also, each of the pixel electrodes PE is located between associated adjacent two of the source lines S as viewed from above and opposite to the common electrode COME as viewed on-side. Furthermore, the pixel electrodes PE include slits SL located opposite to the common electrode COME. Such pixel electrodes PE are formed of transparent conductive material such as ITO or IZO. The first alignment film AL1 covers the pixel electrodes PE and the third insulating film 13.

On the other hand, the second substrate SUB2 is formed of a second insulating substrate 15 having a light transmission characteristic, such as a glass substrate or a resin substrate. On a side of the second insulating film 15 which is located opposite to the first substrate SUB1, the second substrate SUB2 comprises black matrixes BM, color filters CFR, CFG and CFB, an overcoat layer OC, a second alignment film AL2, etc.

The black matrixes BM are formed on an inner surface of the second insulating film 15, and partition pixels. Color filters CFR, CFG and CFB are also formed on the inner surface of the second insulating film 15, and partially stacked on the black matrixes BM. The color filters CFR are red filters; the color filters CFG are green filters; and the color filters CFB are blue filters. The overcoat layer OC covers the color filters CFR, CFG and CFB. Also, the overcoat layer OC is formed of transparent resin material. The second alignment film AL2 covers the overcoat layer OC.

A detection electrode DETE is formed on an outer surface of the second insulating film 15. Although the detection electrode DETE includes detection electrodes arranged in the manner of stripes, which will be described later, and it is simply shown. Also, a detailed figure of lead lines is omitted. The structure of the detection electrode DETE will be described in detail later. The detection electrode DETE is formed of transparent conducive material such as ITO or IZO.

The backlight BLT is provided on a rear surface side of the display panel PNL. As the backlight BLT, various types of backlights can be applied, and for example, a backlight employing a light emitting diode (LED) or a cold-cathode fluorescent lamp (CCFL) as a light source can be applied. A detailed explanation of the structure of the backlight BLT will be omitted.

The first optical element OD1 is provided between the first insulating substrate 10 and the backlight BLT. The second optical element OD2 is provided above or on the detection electrode DETE. Each of the first optical element OD1 and the second optical element OD2 includes at least a polarizing plate, and may include a retardation plate as occasion demands.

Next, a touch sensor applied to the display device DSP having the touch detection function according to the first embodiment will be explained. As a method of detecting that the user's finger or a pen touches the touch panel or is close to the touch panel, a principle of a mutual detection method will be explained.

Figure 3:
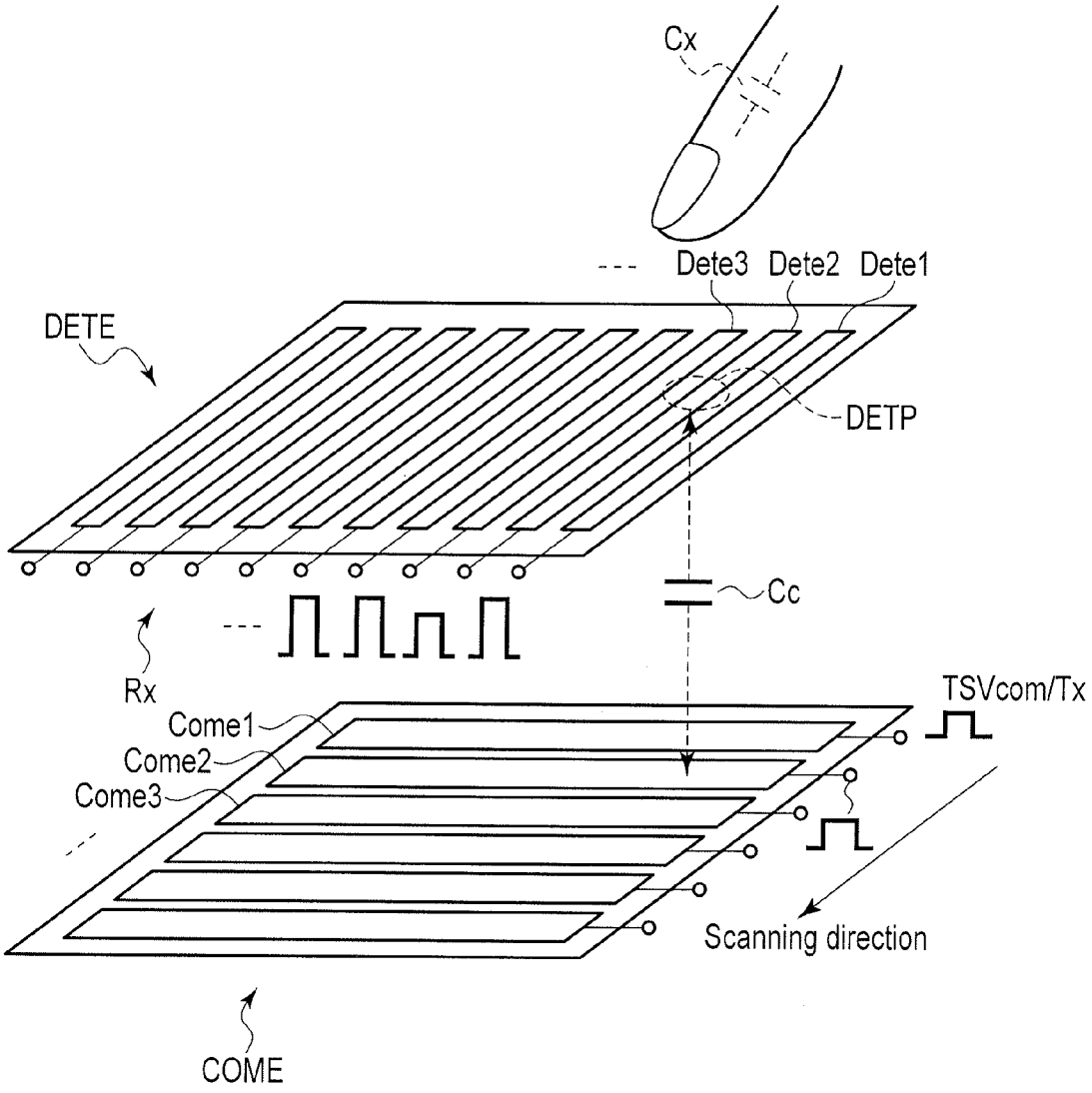
FIG. 3 is an exemplary view showing a representative basic structure with respect to a mutual detection method of the display device having the touch detection function according to the first embodiment.

FIG. 3 is an exemplary view showing a representative basic structure of the mutual detection method of the display device DSP having the touch detection function according to the first embodiment. The common electrode COME and the detection electrode DETE are used. The common electrode COME includes a plurality of common electrodes Come1, Come2, Come3, . . . arranged in the manner of stripes. The common electrodes Come1, Come2, Come3, . . . are also arranged in the scanning (driving) direction (Y direction or X direction).

The detection electrode DETE includes a plurality of detection electrodes Dete1, Dete2, Dete3, . . . arranged in the manner of stripes. Those detection electrodes arranged in the manner of stripes may be thinner than the common electrodes arranged in the manner of stripes. The detection electrodes Dete1, Dete2, Dete3 . . . are also arranged in a direction (the X direction or the Y direction) crossing the common electrodes Come1, Come2, Come3, . . . .

The common electrodes Come1, Come2, Come3, . . . arranged in the manner of stripes in the common electrode COME and detection electrodes Dete1, Dete2, Dete3, . . . arranged in the manner of stripes in the detection electrode DETE are spaced from each other. Thus, basically, capacitors Cc are present between the common electrodes Come1, Come2, Come3, . . . and the detection electrodes Dete1, Dete2, Dete3, . . . .

The common electrodes Comet, Come2, Come3, . . . are scanned by drive pulses TSVCOM at predetermined intervals. If the user's finger is located close to the detection electrode Dete2, when the drive pulses TSVCOM are supplied to the common electrode Come2, an amplitude of the detection pulses obtained from the detection electrode Dete2, are lower than that of pulses obtained from the other detection electrodes arranged in the manner of stripes. This is because a capacitance Cx is generated by the finger, and is added to a capacitance Cc. In the mutual detection, the above obtained pulse having a lower amplitude can be used as a detection pulse for a position DETP.

The above capacitance Cx varies in accordance with whether the finger is close to or far from a detection electrode DETE. Thus, the amplitude of the detection pulses also varies in accordance with whether the user's finger is close to or far from the detection electrode DETE. It is therefore possible to determine from the amplitude of the detection pulses how close the finger is to the flat surface of the touch panel. Needless to say, a two-dimensional position of the finger on the flat surface of the touch panel can be detected based on an electrode driving timing of the drive pulses TSVCOM and an output timing of the detection pulses.

Figure 4B:
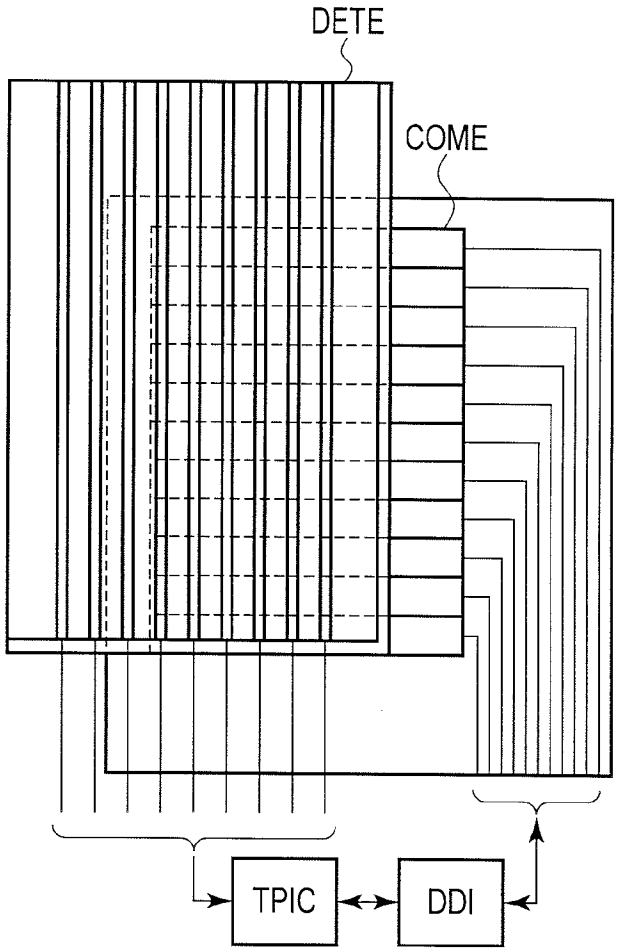
FIG. 4B is another exemplary view schematically showing the structure of the sensor in the display device having the touch detection function according to the first embodiment.
Figure 4A:
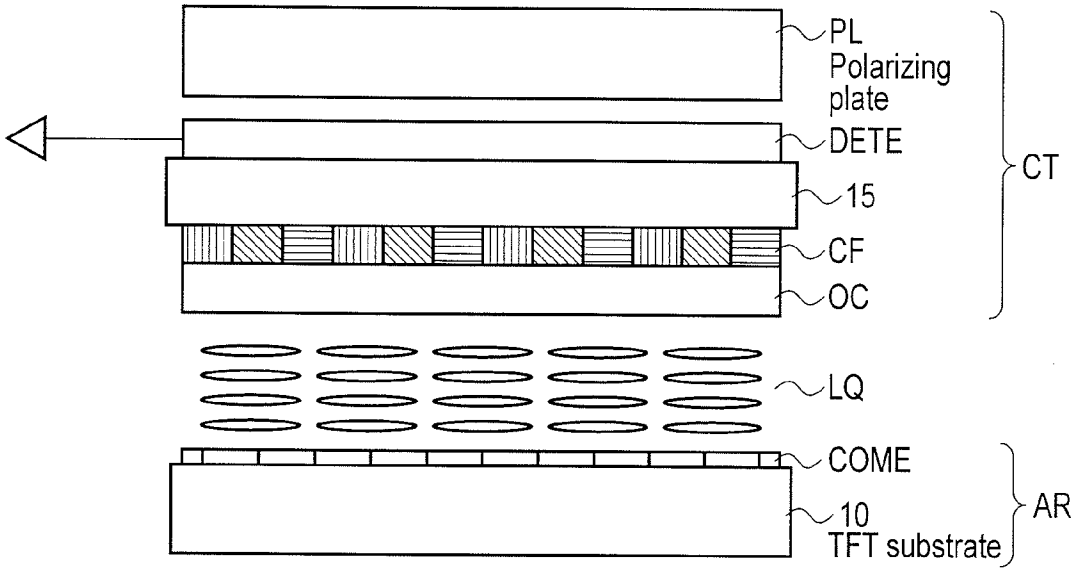
FIG. 4A is an exemplary view schematically showing a structure of a sensor in the display device having the touch detection function according to the first embodiment.

FIGS. 4A and 4B are exemplary views schematically showing the structure of the sensor in the display device DSP having the touch detection function according to the first embodiment. FIG. 4A is a cross-sectional view of the display device DSP having the touch detection function, and FIG. 4B is a plan view showing the structure of the sensor.

As shown in FIG. 4A, the display device DSP having the touch detection function comprises an array substrate AR, a counter-substrate CT and the liquid crystal layer LQ held between the array substrate AR and the counter-substrate CT.

The array substrate AR comprises a TFT substrate 10 and the common electrode COME. The TFT substrate 10 comprises a transparent insulating substrate formed of glass or the like, switching elements not shown, various lines including source lines, gate lines, etc., and a flattening layer which is an insulating film covering those lines. The common electrode COME is provided on the TFT substrate 10 and covered by an insulating layer. The common electrodes Come1, Come2, Come3, . . . included in the common electrode COME, for example, extend in the first direction, and are arranged in the manner of stripes in the second direction crossing the first direction. The common electrodes Come 1, Come2, Come 3, . . . in the common electrode COME are formed of transparent electrode material such as indium tin oxide (ITO) or indium zinc oxide (IZO). In the first embodiment, The common electrodes Come 1, Come2, Come 3, . . . in the common electrode COME are also used as drive electrodes for the sensor.

The counter-substrate CT comprises a transparent insulating substrate 15 such as glass, the color filters CF, the detection electrode DETE and a polarizing plate PL. The color filters CF are provided on the transparent insulating substrate 15, and covered by the overcoat layer OC. The detection electrode DETE is provided on a main outer surface of the transparent insulating substrate 15 (which is located opposite to the color filters CF). The detection electrodes Dete1, Dete2, Dete3, . . . included in the detection electrode DETE extend in a direction (second direction) crossing an extending direction (first direction) of the common electrodes Come1, Come2, Come3, . . . in the common electrode COME, and are arranged in the manner of stripes in the first direction. The detection electrodes Dete1, Dete2, Dete3, . . . in the detection electrode DETE are formed of transparent electrode material such as ITO or IZO. The polarizing plate PL is provided above or on the detection electrode DETE (on a side of the transparent insulating substrate 15 which is located opposite to the color filters CF).

FIG. 4B is a view for use in explaining an example of a structure of each of the above common electrode COME and the detection electrode DETE. In the display device DSP having the touch detection function according to the first embodiment, a touch driver TPIC and a display driver DDI cooperates with each other, whereby drive pulses TSVCOM are input to the common electrode COME, and detection pulses are obtained from the detection electrode DETE. The display driver DDI outputs the drive pulses TSVCOM, and the touch driver TPIC grasps a touch position of the finger based on the position of part of the common electrode COME, to which the drive pulses TSVCOM are input, and the waveform of the detection pulses. It should be noted that it can be set that the touch position is calculated by an external device not shown. A signal output from the display driver DDI and transmission and reception of signals between the display driver DDI and the touch driver TPIC will be explained in detail later.

Figure 5A:
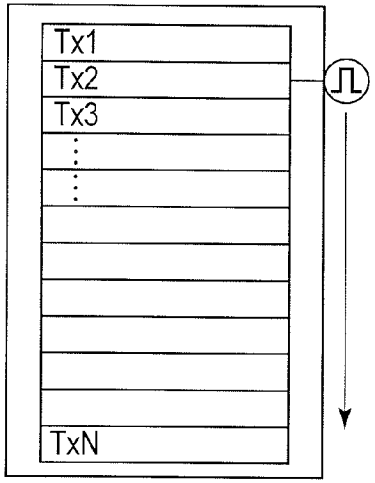
FIG. 5A is an exemplary view for explaining a drive method of the mutual detection method of the display device having the touch detection function according to the first embodiment.
Figure 5B:
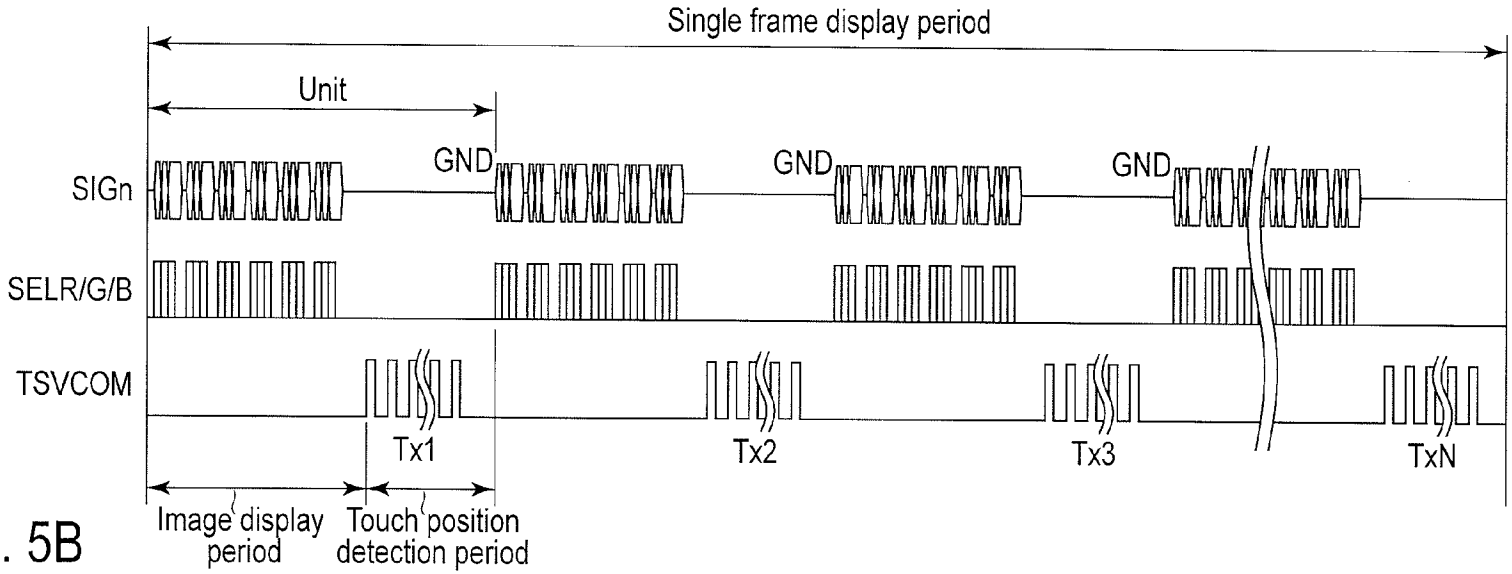
FIG. 5B is another exemplary view for explaining the drive method of the mutual detection method of the display device having the touch detection function according to the first embodiment.

FIGS. 5A and 5B are exemplary views for explaining a drive method of the mutual detection method of the display device DSP having the touch detection function according to the first embodiment.

FIG. 5A shows drive units Tx of the common electrode COME. Drive units Tx1, . . . TxN are formed of common electrodes Come in the common electrodes COME, respectively, which are successively arranged in the manner of stripes. As described above, the common electrodes Come in the common electrodes COME for use in displaying an image are also used as drive electrodes for touch position detection. Thus, an image display operation and a touch position detection operation are performed in a time sharing manner.

In a driving method as shown in FIG. 5B, a single frame period comprises a plurality of units. A single unit is divided into image display periods in each of which an image is displayed and touch position detection periods in each of which a touch position is detected. In the single frame period, the image display periods and the touch position detection periods are alternately repeated. To be more specific, an operation for outputting display signals (SIGn) corresponding to respective colors in response to signals (SELR/G/B) for selecting three colors of RGB is performed with respect to all the display lines, and thereafter a mutual detection operation is performed in which drive pulses TSVCOM are input to the drive units Tx (the common electrodes Come arranged in the manner of stripes). Then, the plurality of display lines and the drive units Tx (Tx1, . . . TxN) are successively subjected to the above operations. It should be noted that the display operation and touch drive operation may be controlled in synchronism with each other such that the display lines and lines of the drive units Tx are made to conform to each other, or may be controlled independent of each other.

Figure 6:
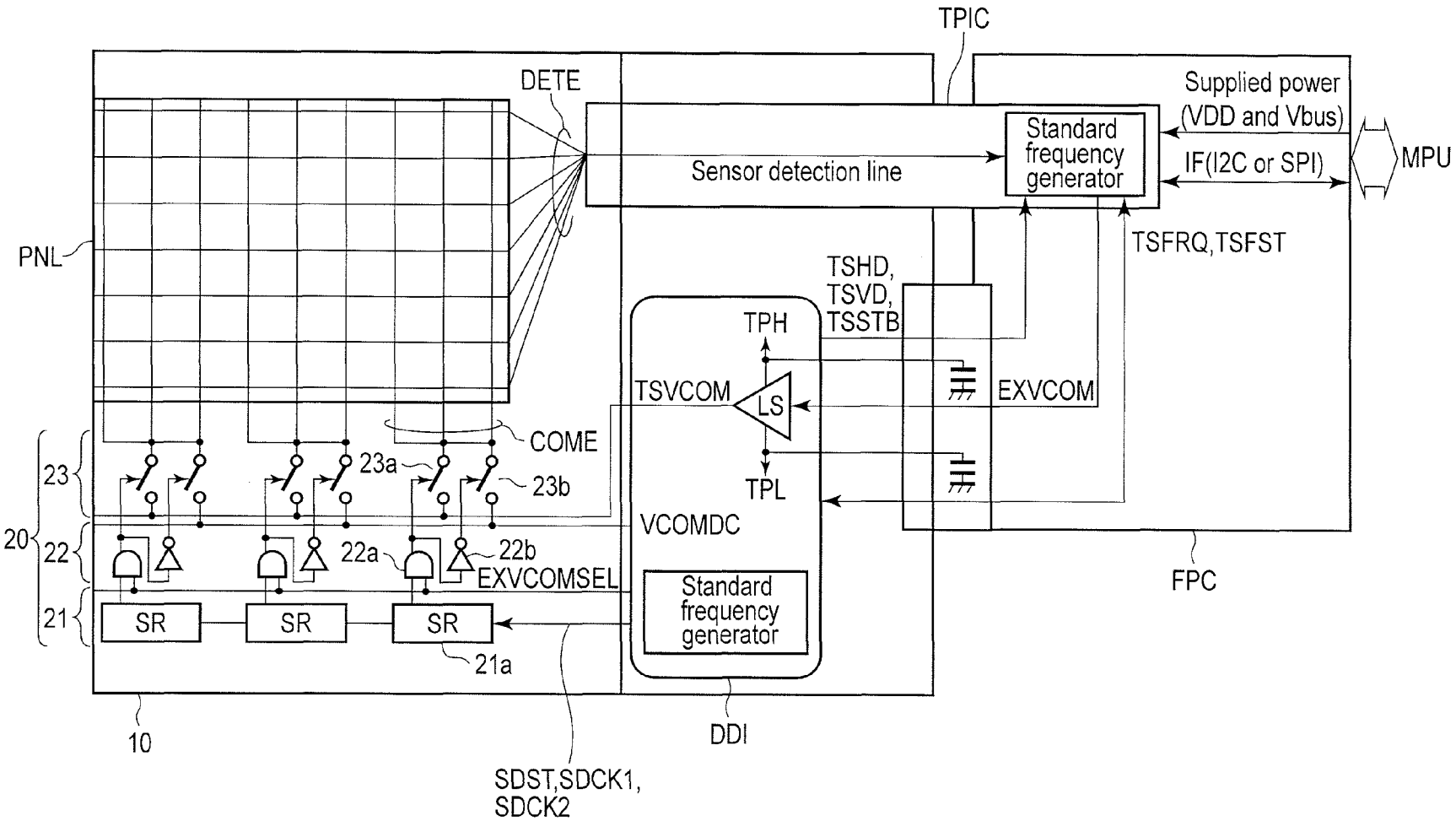
FIG. 6 is an exemplary view for explaining connections of drive signal line in the display device having the touch detection function according to the first embodiment.

FIG. 6 is an exemplary view for explaining connections of drive source lines in the mutual detection method of the display device DSP having the touch detection function, according to the first embodiment. FIG. 6 shows a two-chip system comprising two IC chips, i.e., the touch driver (TPIC) and the display driver (DDI). In this system, the touch driver TPIC and the display driver DDI perform the touch drive operation and the display operation in cooperation with each other.

In the TFT substrate 10, the display driver DDI is provided. Also, in the TFT substrate 10, a touch drive circuit 20 including shift registers SR is provided. A drive signal output from the display driver DDI supplies drive pulses TSVCOM to the common electrode COME through the touch drive circuit 20. In the counter-substrate CT, the detection electrode DETE is provided, and sensor detection lines from the detection electrode DETE are electrically connected to the touch driver TPIC through electrodes for external extension.

The touch driver TPIC is connected to an external signal processor MPU, with a flexible print circuit (FPC) interposed between them. It should be noted that information is transmitted and received between the touch driver TPIC and the signal processor MPU by a communication method such as an inter-integrated circuit (I2C) or a serial peripheral interface (SPI). Also, the touch driver TPIC is supplied with power (VDD, Vbus) from the outside.

Next, transmission and reception of signals between the touch driver TPIC and the display driver DDI will be explained.

The display driver DDI outputs a signal for synchronization to the touch driver TPIC. The signal for synchronization includes a vertical synchronizing signal TSVD and a horizontal synchronizing signal TSHD. The vertical synchronizing signal TSVD is a synchronizing signal indicating a start of a frame. The horizontal synchronizing signal TSHD is a synchronizing signal associated with an operation for each of lines in a frame. The touch driver TPIC outputs a drive synchronizing signal EXVCOM, which accurately synchronizes with a sampling timing for touch detection, to the display driver DDI in synchronism with the horizontal synchronizing signal TSHD. The display driver DDI outputs drive pulses TSVCOM in which the drive synchronizing signal EXVCOM is level-shifted in voltage level and converted in impedance to the touch drive circuit 20.

The touch drive circuit 20 comprises a shift register circuit 21, a selection circuit 22 and a switching circuit 23. A structure and an operation of the touch drive circuit 20 will be explained by referring to by way of example a single shift register 21*a* and a circuit connected thereto.

To the shift register 21*a*, a transfer start pulse SDST and transfer clocks SDCK 1 and SDCK2 are input as transfer-circuit control signals. Shift registers at respective stages are successively supplied with a transfer start pulse SDST using the transfer clocks SDCK1 and SDCK2, and then the transfer start pulse SDST is output from the shift registers at the stages. It should be noted that the above shift register uses two transfer clocks, i.e., the transfer clocks SDCK 1 and SDCK2; however, a shift register adopting a method in which a start pulse is transferred using a single transfer clock may be applied.

An output terminal of the shift register 21*a* is connected to one of input terminals of an AND circuit 22*a* included in the selection circuit 22. To the other input terminal of the AND circuit 22*a*, a drive synchronization selection signal EXVCOMSEL is input. The drive synchronization selection signal EXVCOMSEL is a signal which is set to "1" in the touch position detection period, and set to "0" in the image display period. Thus, in the touch position detection period, and also in a period in which the output of the shift register 21*a* is "1", the output of the AND circuit 22*a* is "1", and the state of a touch switch 23*a* provided in the switching circuit 23 is switched to a connected state (on state). On the other hand, in the image display period, the output of the AND circuit 22*a* is "0". The output of the AND circuit 22*a* is set to "1" by an inverter 22*b* included in the selection circuit 22. The state of a display switch 23*b* included in the switching circuit 23 is switched to the connected state (on state).

Therefore, in the touch position detection period, and in a period in which the output of the above single shift register 21*a* is "1", drive pulses TSVCOM are input to the common electrode COME through the touch switch 23*a*. On the other hand, in a period in which the output of the above single shift register 21*a* is "0", a direct-current signal VCOMDC is input to the common electrodes COME through the touch switch 23*a*. In the image display period, through the display switch 23*b*, the direct-current signal VCOMDC is input to the common electrode COME.

It should be noted that one of ends of the touch switch 23*a*, which is located close to the panel PNL, is connected to at least one of the common electrodes Come arranged in the manner of stripes in the common electrode COME. It is possible to obtain detection signals with a favorable signal to noise ratio by inputting drive pulses TSVCOM, which are supplied as a pulse string, to the above at least one of the common electrodes Come. The number of common electrodes Come arranged in the manner of stripes, which are connected to the above end of the touch switch 23*a* on the panel PNL side, is not limited to a fixed number, and may be variable. Furthermore, in the touch position detection period, the touch drive operation is performed not only on at least one of the common electrodes Come arranged in the manner of stripes, which is connected to the output of the single shift register, but on common electrodes Come arranged in the manner of stripes, which are connected to outputs of a plurality of shift registers.

It should be noted that in the touch driver TPIC, a standard-frequency generator is provided independently. Also, in the display driver DDI, a dedicated standard-frequency generator is provided independently. Therefore, a drive frequency for touch drive can be set to an arbitrary value independent of that for display.

Furthermore, in the touch drive operation, it is possible to exert a frequency shift control for eliminating disturbance noise. For example, if the S/N ratio of a touch signal detected by the touch driver TPIC is low, the touch deriver TPIC outputs a request signal (TSFRG) to change the frequency of the touch drive signal to a smaller value to the display driver DDI. After changing the frequency of the drive signal, the display driver DDI outputs a response signal (TSFST) to the touch driver TPIC. Thereafter, between the touch driver TPIC and the display driver DDI, the touch drive operation is controlled with the changed frequency.

As explained above, the touch driver TPIC and the display driver DDI perform the touch drive operation in cooperation with each other. It should be noted that the display driver DDI, the touch driver TPIC, the touch drive circuit 20, the common electrode COME and the detection electrode DETE as shown in FIG. 6 form the touch detection device. Furthermore, the touch detection device and the display panel PNL form the display device having the touch detection function.

Although in the above explanation, the touch drive operation is referred to, the display driver DDI performs not only the touch drive operation, but also the display operation in accordance with a control signal output from a timing controller (not shown) provided in the display driver DDI. To be more specific, the display driver DDI outputs display signals and a signal for the display operation such that display elements are successively supplied with the display signals and the common electrodes Come included in the common electrode COME are successively supplied with the signal for the display operation.

Then, the following explanation is given with respect to an example of a design made in consideration of a worst case which may be caused by asynchronous operations of the touch driver TPIC and the display driver DDI.

Figure 7:
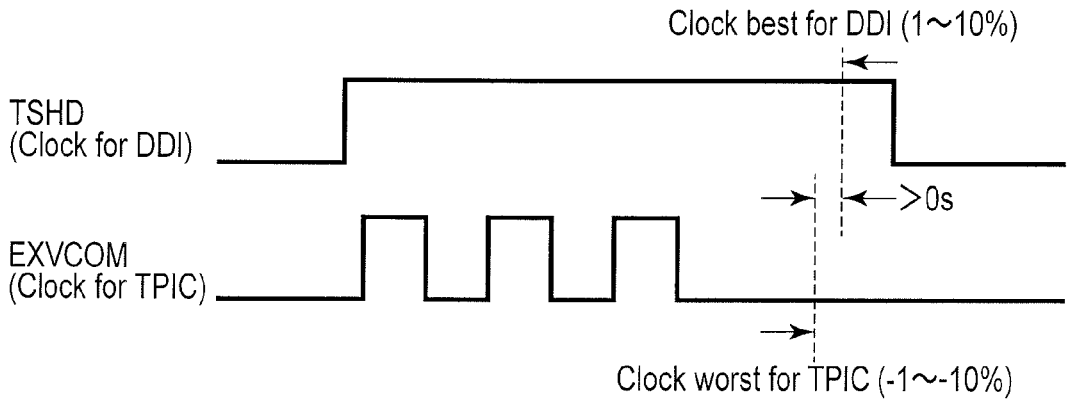
FIG. 7 is an exemplary view for explaining how the number of pulses was determined in deign in consideration of the above worst case with respect to the display device having the touch detection function according to the first embodiment.

FIG. 7 is an exemplary view for explaining how to determine the number of pulses in consideration of the worst pattern in design with respect to the display device DSP having the touch detection function according to the first embodiment. Also, FIG. 7 shows how to set the number of pulses in the touch detection period.

As described above, the display driver DDI outputs a horizontal synchronizing signal TSHD for synchronizing the display driver DDI with the touch driver TPIC. The horizontal synchronizing signal TSHD is a synchronizing signal associated with an operation for each of lines in a frame. The touch driver TPIC outputs to the display driver DDI a drive synchronizing signal EXVCOM, which accurately synchronizes with a sampling timing for touch detection, by a predetermined number of pulses in synchronism with the rising edge of the horizontal synchronizing signal TSHD.

It should be noted that as a matter of convenience for explanation, referring to FIG. 7, time during which the horizontal synchronizing signal TSHD is kept high is also time during which the drive synchronizing signal EXVCOM is permitted to be output. In other words, the drive synchronizing signal EXVCOM is not permitted to be output during a time exceeding the time during which the horizontal synchronizing signal TSHD is kept high. The time during which the drive synchronizing signal EXVCOM is permitted to be output corresponds to a single touch detection period. Also, it should be noted that the time during which the horizontal synchronizing signal TSHD is kept high is time measured by the clock for the display driver DDI. The clock for the display driver DDI is different from that for the touch driver TPIC in master clock. Furthermore, the difference between the clock for the touch driver TPIC and that for the display driver DDI changes due to a temperature change or also varies due to variations in manufacturing clocks. Therefore, in consideration of the above difference between the clocks, for the sake of safety, the time during which the horizontal synchronizing signal TSHD is kept high is set shorter by 1 to 10% than proper time during which the horizontal synchronizing signal TSHD should be kept high. On the other hand, the period of a single pulse of the drive synchronizing signal EXVCOM is time measured on the clock for the touch driver TPIC. Therefore, in consideration of the above difference between the clocks, for the sake of safety, the period of the single pulse of the drive synchronizing signal EXVCOM is set longer by 1 to 10% than a proper period of the single pulse of the drive synchronizing signal EXVCOM.

In such a manner, in the conventional drive method, with respect to the drive synchronizing signal EXVCOM, the number of pulses to be output is determined on the premise that the above difference between the clocks is the greatest (i.e., the worst case), and the touch driver is designed to output the determined number of pulses. The larger the number of pulses in the drive synchronizing signal EXVCOM in the touch position detection period, the higher the accuracy of the touch position detection. Thus, the drive method is required to reasonably increase the number of pulses in the drive synchronizing signal EXVCOM in the touch position detection period.

Figure 8:
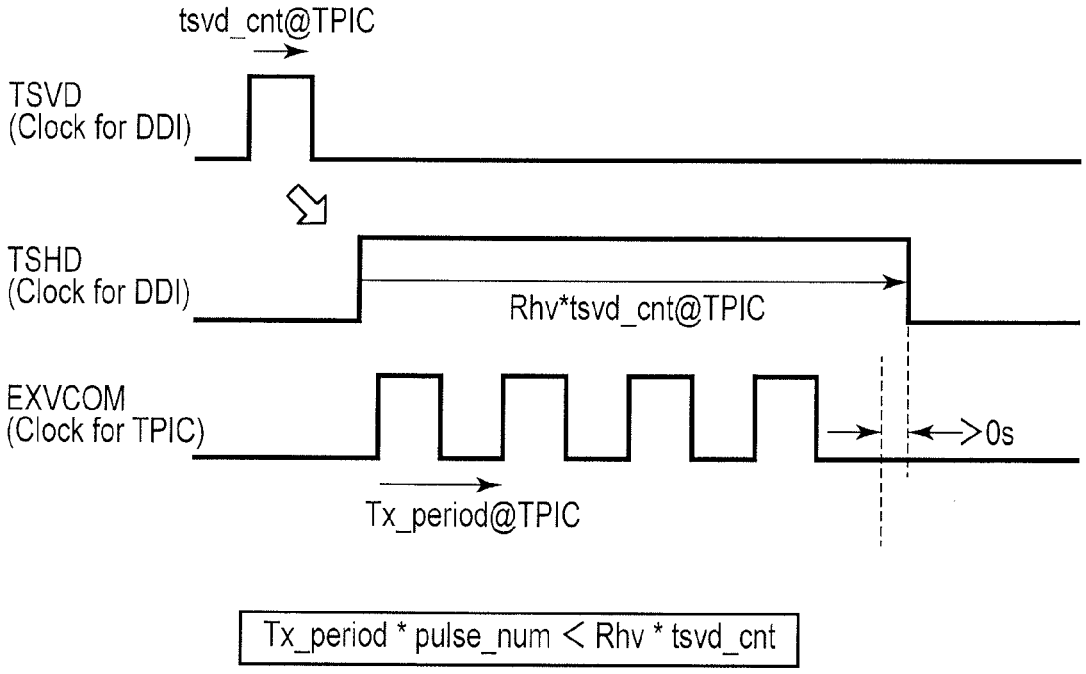
FIG. 8 is an exemplary view for explaining a method of increasing the number of pulses in a drive synchronizing signal in a touch position detection period in the display device having the touch detection function according to the first embodiment.

FIG. 8 is an exemplary view for explaining a method of increasing the number of pulses in the drive synchronizing signal EXVCOM in the touch position detection period in the display device having the touch detection function according to the first embodiment.

Before reception of the horizontal synchronizing signal TSHD, the touch driver TPIC receives from the display driver DDI, a given signal produced based on clocks for the display driver DDI, as a reference signal. In an example shown in FIG. 8, the touch driver TPIC receives a vertical synchronizing signal TSVD indicating the start of a frame. Then, the pulse width of the vertical synchronizing signal TSVD (which corresponds to time in which the vertical synchronizing signal TSVD is kept high) is measured by the clock for the touch driver TPIC. The measured time will be denoted by "tsvd_cnt@TPIC". "@TPIC" following "tsvd_cnt" are characters which indicate that the measured time is recognized by the touch driver TPIC. It should be noted that the time during which the horizontal synchronizing signal TSHD is kept high is Rvh times the pulse width of the vertical synchronizing signal TSVD (time during which the vertical synchronizing signal TSVD is kept high). "RVh" is a design value and also a constant. To be more specific, since the vertical synchronizing signal TSVD and the horizontal synchronizing signal TSHD are both signals produced based on the clocks for the display driver DDI, "RVh" is a value which is invariable regardless of what clocks are applied to measurement.

Therefore, the pulse width (tsvd_cnt) of the vertical synchronizing signal TSVD and the pulse width (tshd_cnt) of the horizontal synchronizing signal TSHD, which are measured by the display driver DDI and the touch driver TPIC, have a relationship expressed by the following equations (1) and (2):

$$tshd_cnt@DDI/tsvd_cnt@DDI = Rvh = tshd_cnt@TPIC/tsvd_cnt@TPIC \quad (1)$$

$$tshd_cnt@TPIC = Rvh \times tsvd_cnt@TPIC \quad (2)$$

It should be noted that where "Tx_period@TPIC" is the period of a single pulse of the drive synchronizing signal EXVCOM, the number of pulses to be determined, which is denoted by "pulse_num", can be found as a maximum number which satisfies the following formula (3). In the formula (3), as a measured value, only a value measured by the touch driver TPIC is applied. Then, by dynamically changing the number of pulses to the value determined by the formula (3), an optimal drive synchronizing signal EXVCOM can be produced.

$$Tx_period@TPIC \times pulse_num < Rvh \times tsvd_cnt@TPIC \quad (3)$$

The pulse width (time) of an arbitrary signal (the vertical synchronizing signal TSVD in the example shown in FIG. 7) based on the clock for the display driver DDI is measured on the clock for the touch driver TPIC, and the number of pulses which the drive synchronizing signal EXVCOM should have is dynamically calculated from the above measured pulse width, the constant Rvh (the ratio of the horizontal synchronizing signal TSHD to the vertical synchronizing signal TSVD, which is measured on the same clock, in the example shown in FIG. 7) and the period of the single pulse of the drive synchronizing signal EXVCOM.

In this case, the maximum number of pulses can also be determined by applying a design value as the period (Tx_period) of the single pulse signal of the drive synchronizing signal EXVCOM. Also, as the period (Tx_period) of the single pulse signal, it is possible to apply a currently used value (current value), not the design value. Then, by applying the period (Tx_period) of the single pulse signal, the number of pulses is determined such that the drive synchronizing signal EXVCOM has the maximum number of pulses. Furthermore, by applying the determined number of pulses, it is possible to determine a maximum period (Tx_period) of the single pulse signal which satisfies the formula (3). It should be noted that if the number of pulses is unchanged as in the conventional drive method, there is a case where only the period (Tx_period) of the single pulse signal is changed. Also, the number of pulses and the period (Tx_period) of the single pulse signal of the drive synchronizing signal EXVCOM may be both dynamically determined in the above manner. Thereby, an optimal drive synchronizing signal EXVCOM can be obtained.

Figure 9:
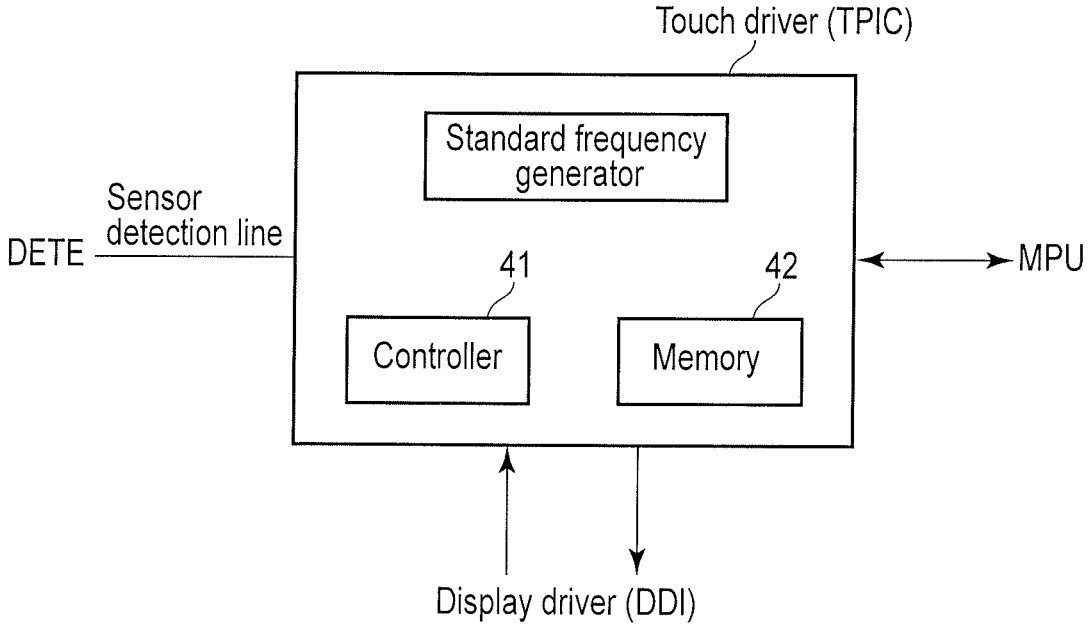
FIG. 9 is an exemplary view showing a configuration of a touch driver of the display device having the touch detection function according to the first embodiment.

FIG. 9 is an exemplary view showing a configuration of the touch driver TPIC of the display device DSP having the touch detection function according to the first embodiment.

The touch driver TPIC comprises a controller 41 and a memory 42. The controller 41 exercises a centralized control of operations of the touch driver TPIC. The memory 42 stores information for controlling the operation of the touch driver TPIC. The controller 41 transmits and receives a signal for the touch driving operation to and from the display driver DDI, and also obtain detection pulses from the detection electrode DETE to recognize the touch position of the finger. Also, the controller 41 executes transmission and reception of information to and from a signal processor MPU. Furthermore, the controller 41 exercises the above control of dynamically changing the number of pulses in the drive synchronizing signal EXVCOM. It should be noted that the standard frequency generator provided in the touch driver TPIC supplies a reference clock based on which the controller 41 and the memory 42 are driven.

Figure 10:
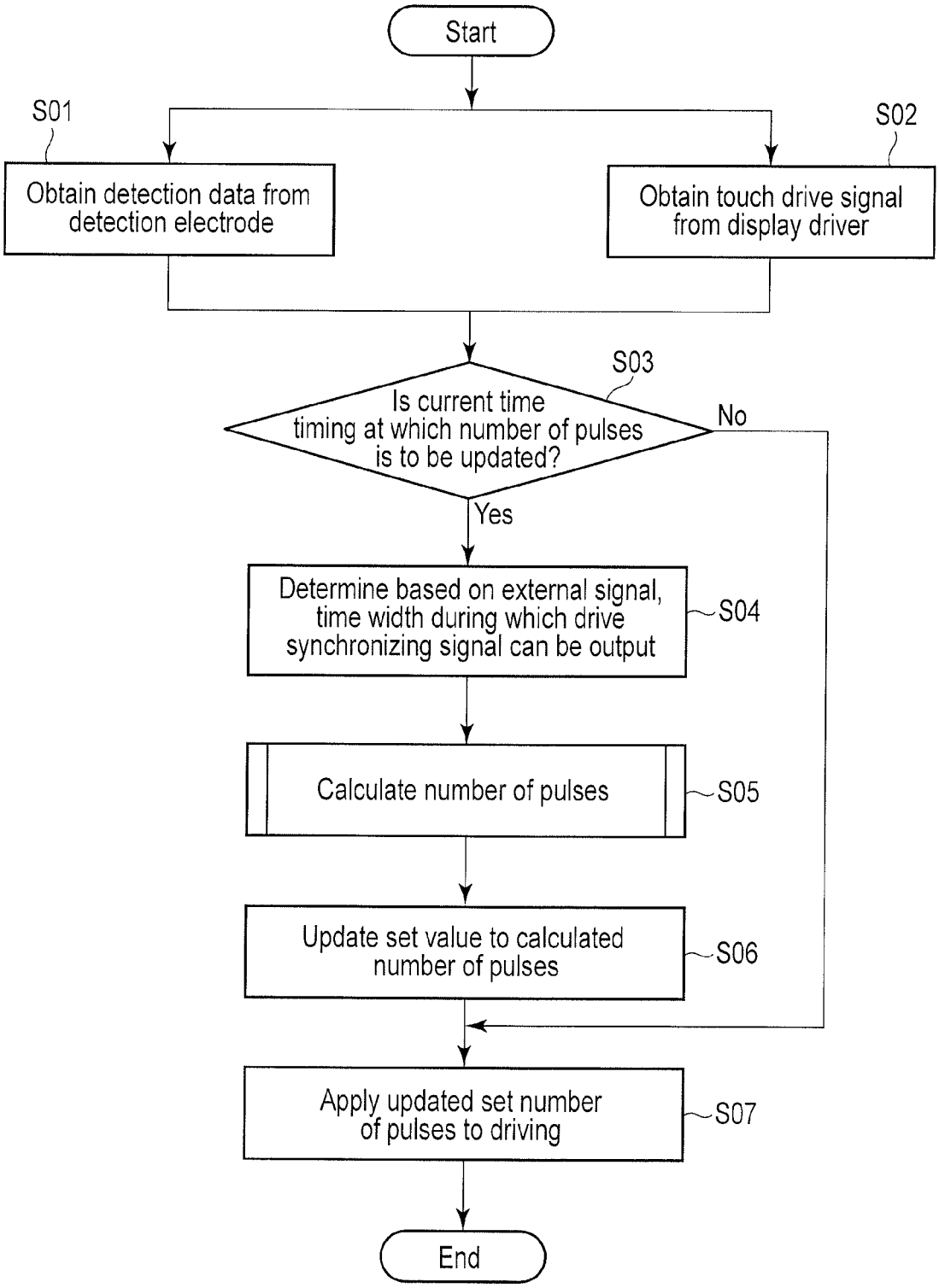
FIG. 10 is an exemplary flowchart showing a procedure of a control of dynamically changing the number of pulses in a drive synchronizing signal in the touch driver of the display device having the touch detection function according to the first embodiment.

FIG. 10 is an exemplary flowchart showing a procedure of a control of dynamically changing the number of pulses in the drive synchronizing signal EXVCOM in the touch driver TPIC of the display device DSP having the touch detection function according to the first embodiment;

In step S01, the controller 41 obtains detection pulses from the detection electrode DETE to recognize the touch position of the finger. In parallel with this operation in step S01, in step S02, the controller 41 obtains a touch drive signal from the display driver DDI. In step S03, the controller 41 checks whether or not current time is the timing at which the number of pulses is to be updated. For example, the number of pulses may be updated in units of one frame or in units of a predetermined number of frames. If the above timing is not the timing at which the number of pulses is to be updated (No in step S03), in step S07, the controller 41 outputs a drive synchronizing signal EXVCOM by a previously determined number of pulses.

If the current time is the timing during which the number of pulses should be updated (Yes in step S03), in step S04, the controller 41 determines a time width in which the drive synchronizing signal can be output, based on a touch drive signal (external signal) obtained at intermediate timing between a previous update timing and a current update timing. Then, in step S05, the controller 41 calculates the number of pulses as a new one.

Figure 11A:
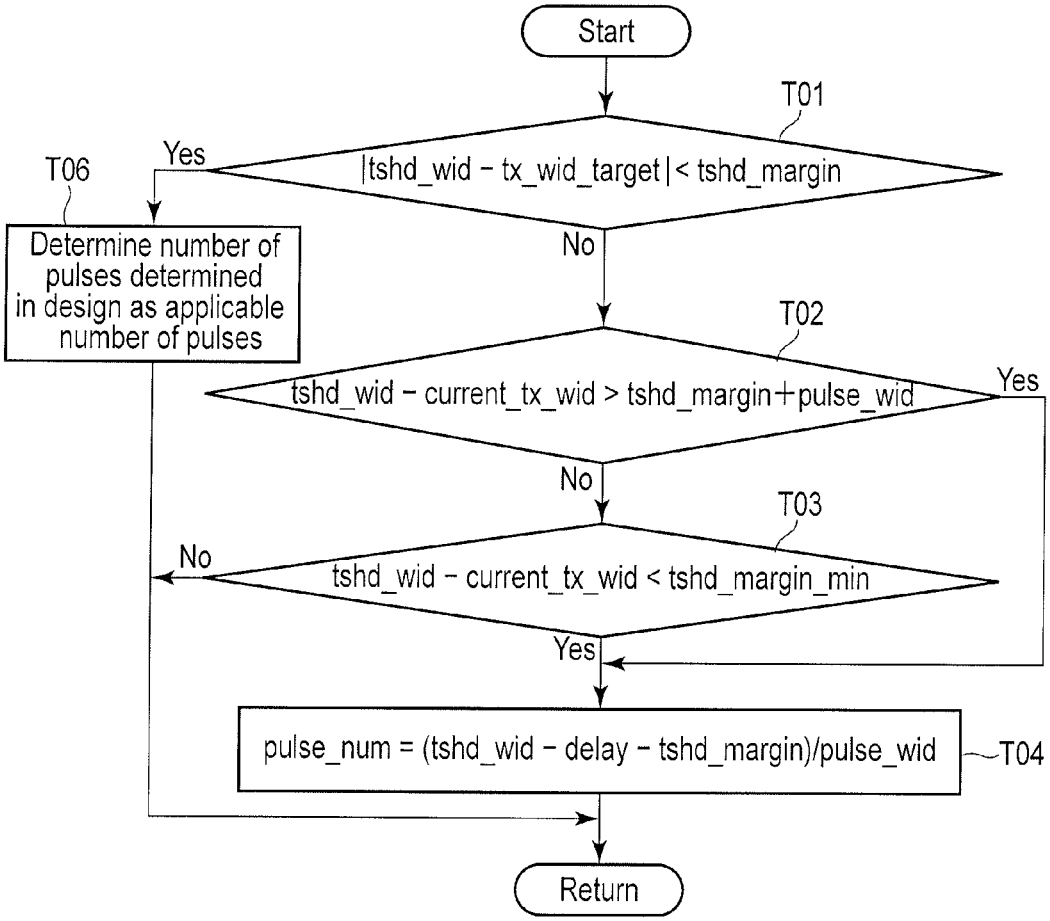
FIG. 11A is an exemplary view showing a procedure for newly calculating the number of pulses in the drive synchronizing signal in the touch driver of the display device having the touch detection function according to the first embodiment.
Figure 11B:
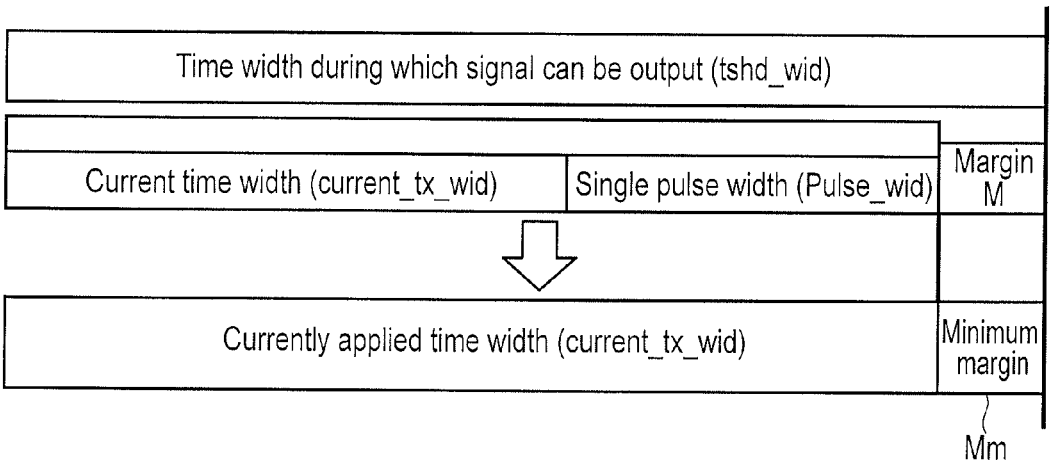
FIG. 11B is another exemplary view showing the procedure for newly calculating the number of pulses in the drive synchronizing signal in the touch driver of the display device having the touch detection function according to the first embodiment.

FIGS. 11A and 11B are exemplary views each showing a procedure for newly calculating the number of pulses in the drive synchronizing signal EXVCOM in the touch driver TPIC of the display device DSP having the touch detection function according to the first embodiment. FIG. 11A is a flowchart, and FIG. 11B is a view showing a correlation between applied variables. The flowchart of FIG. 11A will be explained with reference to FIG. 11B.

In step T01 as shown in FIG. 11A, with respect to the time width during which the drive synchronizing signal can be output, it is checked whether an absolute value of a time width obtained by subtracting a time width (tx_wid_target) determined in design from a time width (tshd_wid) determined in a main routine is smaller than a predetermined margin M (tshd_margin) or not. If the difference is smaller than the predetermined margin M (tshd_margin) (Yes In step T01), since the time width determined in design is applicable, in step T06, the time width is determined as a time width to be applied, and the processing is returned to a main routine.

On the other hand, if the absolute value of the time width is greater than the predetermined margin M (tshd_margin) (No in step T01), since there is a possibility that the number of pulses will be changed from a previously determined number, in step T02, it is checked whether a value of a time width obtained by subtracting a currently applied time width (current_tshd_wid) from the above determined time width (tshd_wid) is greater than the sum of a single pulse width (pulse_wid) and the margin M (tshd_margin) or not. That is, it is checked whether the number of pulses can be increased or not. If the number of pulses can be increased (Yes in step T02), the number of pulses (pulse_num) is determined in accordance with the following equation (4). It should be noted that in the equation (4), "delay" is a time period indicating an allowance. After the above determination, the processing is returned to the main routine.

$$\text{pulse_}num=(tshd_wid-\text{delay}-tshd_\text{margin})/\text{pulse_}wid \quad (4)$$

If the number of pulses cannot be increased (No in step T02), in step T03, it is checked whether the value of a time width obtained by subtracting the currently applied time width (current_tshd_wid) from the above determined time width (tshd_wid) is smaller than a minimum margin Mm (tshd_margin_min) or not. That is, it is checked whether the number of pulses can be decreased or not. If the number of pulses can be decreased (Yes in step T03), the number of pulses (pulse_num) is determined in accordance with the equation (4). Then, the processing is returned to the main routine. On the other hand, if the number of pulses cannot be decreased (No in step T03), the processing is returned to the main routine without changing the number of pulses (pulse_num).

In step S06 as shown in FIG. 10, the controller 41 updates the set number of pulses to the calculated number of pulses (pulse_num), and in step S07, the controller 41 outputs the drive synchronizing signal EXVCOM by pulses whose number is equal to the updated set number of pulses.

It should be noted that at the time of starting the display device upon power-up or at the time of resuming (restarting) the device from its suspended state or the like, the device may be driven with pulses the number of which is determined in design (in consideration of the case where the clock for the touch driver is the slowest and the clock for the display driver DDI is the fastest), and then may be driven at an appropriate timing with pulses the number of which is determined in accordance with the above calculation logic for the number of pulses. Furthermore, it may be set that at the time of starting the display device upon power-up or resuming (restarting) the device from its suspended state, with respect to a predetermined number of frames the time width is measured for calculation of the number of pulses without performing the touch drive operation, and driving is then performed at an appropriate timing with pulses the number of which is determined in accordance with the above calculation logic for the number of pulses.

In the first embodiment, the time width of the horizontal synchronizing signal TSHD is determined based on measurement of the vertical synchronizing signal TSVD; however, determination of the time width is not limited to such a determination. For example, a time width during which the drive synchronizing signal can be output can be determined based on measurement of an arbitrary external signal input from the display driver DDI.

Furthermore, in the first embodiment, the number of pulses is controlled by the controller 41 provided in the touch driver TPIC. However, the control of the number of pulses is not limited to such a control. For example, it may be set in structure that a controller is provided outside the touch driver TPIC, and exchanges information with the touch driver TPIC, to thereby control the number of pulses.

It is also possible to perform not only changing of the number of pulses, but changing of the pulse width, in addition to the control of the number of pulses.

It should be noted that such a panel structure as described with respect to the first embodiment is explained by way of example only. The embodiments are not limited to the scope of the above disclosure.

With respect to the first embodiment, a panel using a liquid crystal which is of a lateral electric-field type such as an in-plane switching (IPS) mode or a fringe-field switching (FFS) mode is referred to by way of example; however, the panel applied to the first embodiment is not limited to such a type of panel. That is, the embodiment can also be applied to a panel using a liquid crystal which is of a vertical electric-field type such as a twisted nematic (TN) mode or an optically compensated bend (OCB) mode.

Furthermore, with respect to the first embodiment, as the display device having the touch detection function, a so-called in-cell type display device is referred to by way of example. However, the embodiment can also be applied to a so-called on-cell type display device in which a touch panel is provided on a display surface of the display device.

All display devices which can be put to practical use by a person with ordinary skill in the art by changing as appropriate the design of the display device according to the embodiment are covered by the disclosure of the present application, as long as they have the subject matter of the invention.

It can be understood that within the scope of the technical concept of the invention, various modifications of the embodiment can be conceived by a person with ordinary skill in the art, and also fall within the scope of disclosure of the present application with respect to the embodiment. For example, with respect to the embodiment, if a person with ordinary skill in the art adds or deletes a structural element or changes a design as appropriate, or adds or omits a step or changes a design, a modification obtained by such a change also falls within the scope of disclosure of the present application with respect to the embodiments described herein, as long as it has the subject matter of the invention.

Furthermore, in addition to the above advantages obtained by the embodiments, if another or other advantages can be obviously considered to be obtained in the embodiments from the specification or can be conceived as appropriate by a person with ordinary sill in the art from the specification, it is understood that such another or other advantages can also be obtained by the embodiments described herein.

It is also possible to make various inventions by combining as appropriate, structural elements as disclosed with respect to the above embodiments. For example, some of the structural elements in the embodiment may be deleted. Also, structural elements used in both embodiments may be combined as appropriate.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A display device having touch detection function, comprising:

a plurality of drive electrodes;

a plurality of detection electrodes provided to generate capacitances with the drive electrodes;

a display driver configured to perform a touch scanning drive by supplying a touch drive signal having pulses for detecting proximity of an external object to a target drive electrode to be driven, which is selected from the drive electrodes;

a touch driver configured to transmit and receive a signal to and from the display driver, output a drive synchronizing signal to the display driver for producing the touch drive signal, and acquire detection signals from the detection electrodes at timing corresponding to inputting of the touch drive signal, to detect the proximity of the external object; and display pixels configured to perform display based on display signals and a display drive signal, wherein the touch driver determines at least one of the number of pulses of the drive synchronizing signal and a pulse width of each of the pulses of the drive synchronizing signal based on the signal received from the display driver, the touch driver measures a first time based on the signal received from the display driver, makes a calculation using the first time and a constant to determine a longest time during which the drive synchronizing signal is allowed to be output, and also determines a maximum number of pulses which are supplied in the longest time, as the number of pulses of the drive synchronizing signal, the display driver repeatedly alternately performs a display scanning drive and the touch scanning drive in a time sharing manner, and in the display scanning drive, the display diver supplies the display drive signal to the drive electrodes in turn.

2. The display device having touch detection function, according to claim 1, wherein in the touch scanning drive, the display driver supplies the touch drive signal to the same drive electrode as the display driver supplies the display drive signal in the display scanning drive, the touch drive signal and the display drive signal being supplied to the same drive electrode in a time sharing manner.

3. The display device having touch detection function, according to claim 2, wherein in units of at least one frame, the touch driver determines at least one of the number of pulses of the drive synchronizing signal and the pulse width of each of the pulses of the drive synchronizing signal based on the signal received from the display driver.

4. The display device having touch detection function, according to claim 1, wherein in units of at least one frame, the touch driver determines at least one of the number of pulses of the drive synchronizing signal and the pulse width of each of the pulses of the drive synchronizing signal based on the signal received from the display driver.

5. A touch detection device comprising:

a plurality of drive electrodes;

a plurality of detection electrodes provided to generate capacitances with the drive electrodes;

a display driver configured to perform a touch scanning drive by supplying a touch drive signal having pulses for detecting proximity of an external object to a target drive electrode, which is selected from the drive electrodes; and a touch driver configured to transmit and receive a signal to and from the display driver, output a drive synchronizing signal to the display driver for producing the touch drive signal, and acquire detection signals from the detection electrodes at timing corresponding to inputting of the touch drive signal, to detect the proximity of the external object, wherein at least one of the number of pulses of the drive synchronizing signal and a pulse width of each of the pulses of the drive synchronizing signal is determined based on the signal received from the display driver, the touch driver determines at least one of the number of the pulses of the drive synchronizing signal and the pulse width of the each of the pulses based on the signal received from the display driver, and the touch driver measures a first time based on the signal received from the display driver, makes a calculation using the first time and a constant to determine a longest time during which the drive synchronizing signal is allowed to be output, and also determines a maximum number of pulses which are supplied in the longest time, as the number of pulses of the drive synchronizing signal.

6. The touch detection device, according to claim 5, further comprising display pixels configured to perform display based on display signals and a display drive signal, wherein the display driver repeatedly alternately performs a display scanning drive and the touch scanning drive in a time sharing manner, and in the display scanning drive, the display diver supplies the display drive signal to the drive electrodes in turn.

7. The touch detection device, according to claim 6, wherein in the touch scanning drive, the display driver supplies the touch drive signal to the same drive electrode as the display driver supplies the display drive signal in the display scanning drive, the touch drive signal and the display drive signal being supplied to the same drive electrode in a time sharing manner.

8. The touch detection device, according to claim 7, wherein in units of at least one frame, the touch driver determines at least one of the number of pulses of the drive synchronizing signal and the pulse width of each of the pulses of the drive synchronizing signal based on the signal received from the display driver.

9. The touch detection device, according to claim 6, wherein in units of at least one frame, the touch driver determines at least one of the number of pulses of the drive synchronizing signal and the pulse width of each of the pulses of the drive synchronizing signal based on the signal received from the display driver.

10. The touch detection device, according to claim 5, further comprising display pixels configured to perform display based on display signals and a display drive signal, wherein the touch driver determines at least one of the number of pulses of the drive synchronizing signal and a pulse width of each of the pulses of the drive synchronizing signal based on the signal received from the display driver, and the display driver repeatedly alternately performs a display scanning drive and the touch scanning drive in a time sharing manner, and in the display scanning drive, the display diver supplies the display drive signal to the drive electrodes in turn.

11. The touch detection device, according to claim 10, wherein in the touch scanning drive, the display driver supplies the touch drive signal to the same drive electrode as the display driver supplies the display drive signal in the display scanning drive, the touch drive signal and the display drive signal being supplied to the same drive electrode in a time sharing manner.

12. The touch detection device, according to claim 11, wherein in units of at least one frame, the touch driver determines at least one of the number of pulses of the drive synchronizing signal and the pulse width of each of the pulses of the drive synchronizing signal based on the signal received from the display driver.

13. The touch detection device, according to claim 10, wherein in units of at least one frame, the touch driver determines at least one of the number of pulses of the drive synchronizing signal and the pulse width of each of the pulses of the drive synchronizing signal based on the signal received from the display driver.

* * * * *